United States Patent [19]

Lowder

[11] 4,073,043

[45] Feb. 14, 1978

[54] DRIVE SYSTEM FOR NAPPER MACHINE STRIPPERS

[76] Inventor: Vander B. Lowder, 320 Bypass - 29 North, Concord, N.C. 28025

[21] Appl. No.: 775,881

[22] Filed: Mar. 9, 1977

[51] Int. Cl.[2] ..... D06C 11/00

[52] U.S. Cl. ..... 26/33; 192/56 R

[58] Field of Search ..... 26/33, 34, 35; 192/56 R

[56] References Cited

U.S. PATENT DOCUMENTS

| | | | |
|---|---|---|---|
| 511,609 | 12/1893 | Gessner | 26/33 |
| 1,154,350 | 9/1915 | Thiel | 26/33 |
| 1,204,150 | 11/1916 | Gessner | 26/34 |
| 2,259,824 | 10/1941 | Lowder | 192/56 R |

FOREIGN PATENT DOCUMENTS

| | | | |
|---|---|---|---|
| 513,857 | 12/1930 | Germany | 26/33 |
| 738,620 | 8/1943 | Germany | 26/33 |
| 1,137,713 | 10/1962 | Germany | 26/33 |
| 9,096 | 1891 | United Kingdom | 26/35 |
| 195,480 | 4/1923 | United Kingdom | 26/33 |

*Primary Examiner*—Robert R. Mackey
*Attorney, Agent, or Firm*—Bacon & Thomas

[57] ABSTRACT

A pair of napper stripper drive shafts interconnected by gearing are each provided with independent overload release clutches that permit overload release of each stripper drive shaft from a single input drive gear without disturbing the timed relationship of the other to the input drive gear. The pair of clutches divide the driving load to the stripper drive shafts so that a more sensitive release spring can be utilized in each clutch. When a stripper is jammed or resists rotation, its respective clutch opens and is locked in the released position until it is manually reset by a pushbutton. Reengagement of the released clutch can only be made when the stripper drive shaft is rotated to its proper timed position, and the clutch is arranged so that the stripper drive shaft can be turned independently of the drive gearing when the clutch is in its released position.

4 Claims, 8 Drawing Figures

DRIVE SYSTEM FOR NAPPER MACHINE STRIPPERS

BACKGROUND OF THE INVENTION

This invention relates generally to a drive system for the lint cleaners, or strippers, of a cloth napper machine, and more specifically to an overload release arrangement for such drive system.

A pair of rotating napper strippers in a cloth napper machine conventionally are driven through gearing that enables the stripper driving shafts to be driven synchronously with a rotating annular carrier that carries rotating napper rollers on its periphery. The stripper drive shafts are contra-rotating and driven in timed relationship with the carrier. The napper rollers carry wire card cloth on their surfaces, the cloth comprising slanted wire needles that are closely spaced to each other. The strippers are each in the form of a pair of radially extending wire brushes mounted on the stripper drive shafts in diametrically opposed relationship. The strippers clean the lint from the napper rollers by brushing a card cloth material in the same direction that it is slanted. Therefore, each napper roller, which itself is rotating about its own axis, is cleaned by one or the other of the napper strippers, depending on its own direction of rotation and the slant of its respective card cloth. A specific napper roller will be cleaned only by one specific stripper that is rotating in a proper sense to clean a card cloth from the inside outwardly. The napper rollers must not be contacted by the wrong napper stripper or the card cloth will be dulled and burred by the cleaning brushes.

Because of the operating relationship of the elements, it is critical that the timing of the napper strippers be maintained with respect to the rotating carrier and rotating nappers at all times. Any disruption of the synchronous operation of the elements will create difficulties and expenses on the part of the machine operator and result in an inferior napper fabric produced by the machine.

It is not an uncommon occurrence in a napper machine that the fabric being napped is caught up in one or more napper rollers or is simply caught upon and dragged around with the carrier. When this happens, usually the fabric is brought into contact with one or both of the napper strippers and caught up therein before the machine can be shut down. If no overload release means were provided for the napper stripper drive shafts, the stripper drive gearing would be damaged.

Overload reliefs for napper stripper drive trains are therefore provided to prevent damage to the gearing and the fabric being napped. An early teaching of providing such an overload release for a napper stripper is illustrated in U.S. Pat. No. 1,154,350, where a single relief is shown provided in the gear train driving a pair of napper strippers.

The present invention is intended to provide an improvement over the prior art overload clutch release systems used for napper strippers and is a specific adaptation of an overload release clutch described in U.S. Pat. No. 2,259,824 issued Oct. 21, 1941.

SUMMARY OF THE INVENTION

This invention has for its primary objective the provision of an overload clutch release system for the drive shafts of a pair of napper strippers in a cloth napper machine, such system featuring two independent clutch mechanisms, each clutch associated with a separate napper stripper drive shaft. The drive shafts are interconnected by gearing that remains interconnected even when the clutches are released. Therefore, release of one clutch connected to a first napper stripper does not affect the timing of the second napper stripper, because the gearing between the stripper drive shafts is not disengaged when a clutch release occurs.

An automatic shut-off switch is provided to sense when a clutch has been released to shut the machine off immediately upon release of either or both of the clutches. A released clutch is maintained in the released condition by a latch pin arrangement and the clutch cannot be reengaged until manually reset through a pushbutton. The timed relationship of the napper strippers is insured by providing an arrangement of lug and recesses on the clutch mechanism that can be engaged only when the relatively rotating parts are aligned in a predetermined relationship.

DETAILED DESCRIPTION OF THE INVENTION

DETAILED DESCRIPTION

Figure 1:
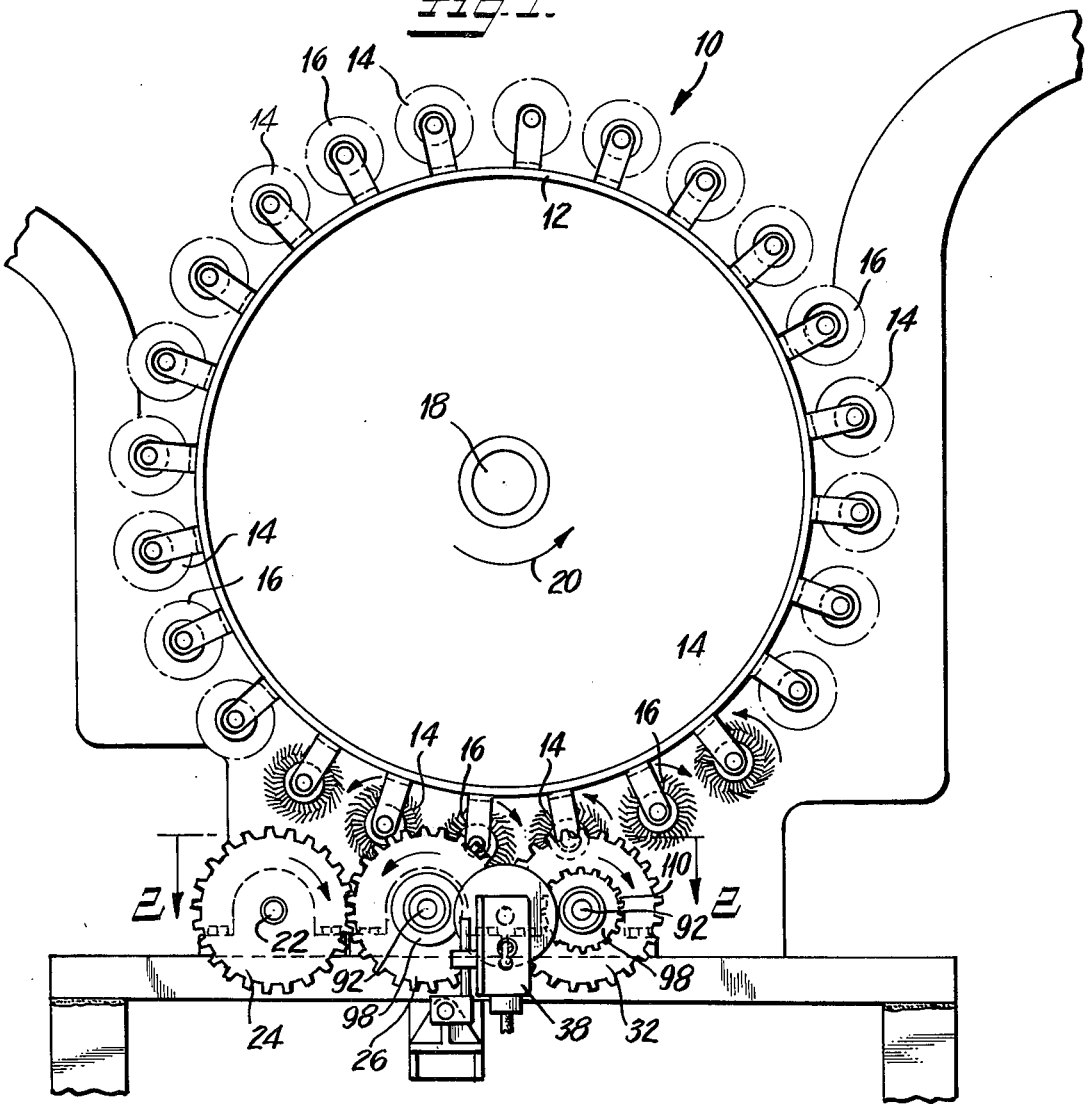
FIG. 1 is an end elevational view of the napper stripper drive mechanism constructed in accordance with the present invention, and showing its relationship to a napper machine which is shown diagrammatically.
Figure 8:
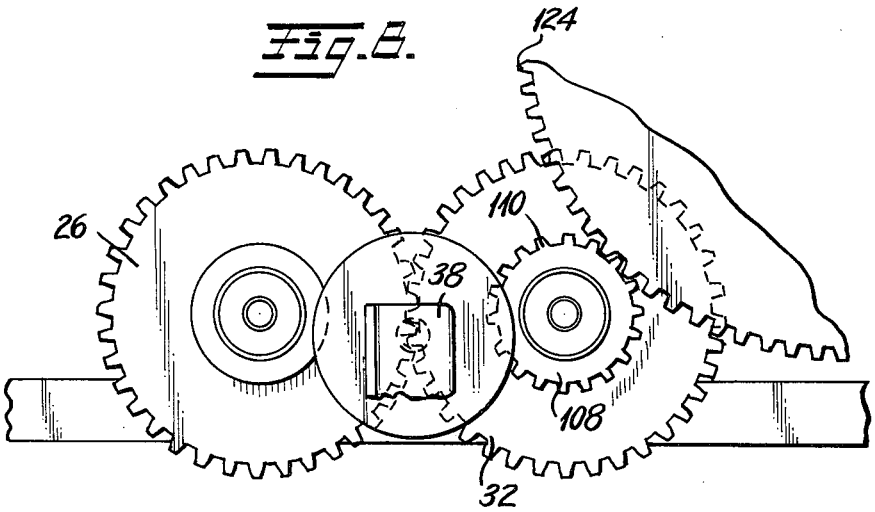
FIG. 8 is a fragmentary end elevational view of an alternate drive arrangement for the napper stripper drive shafts.

With reference to the drawings, FIG. 1 generally shows a cloth napping machine 10 having a rotatable, annular central carrier 12 upon which are mounted, in circumferentially spaced relationship, napper rollers 14, 16 that are driven to rotate in contra-rotating senses (alternate rollers rotate in opposite senses while the carrier 12 rotates the entire napper roller assembly in one direction about central shaft 18 of carrier 12. Napper rollers 14, for example, assuming carrier 12 is turning in the direction of arrow 20, rotate in a counterclockwise sense, while napper rollers 16 rotate in a clockwise sense, and so forth. Napper rollers 14 and 16 have carding cloth on their surfaces that includes wire needles slanted in the direction of rotation of the respective napper roller. Cloth fabric to be treated is fed to the napper machine so that it passes over the carrier 12 in contact with the napper rollers 14, 16. The card cloth on the napper rollers raises the nap of the cloth in a conventional, well-known manner.

Figure 2:
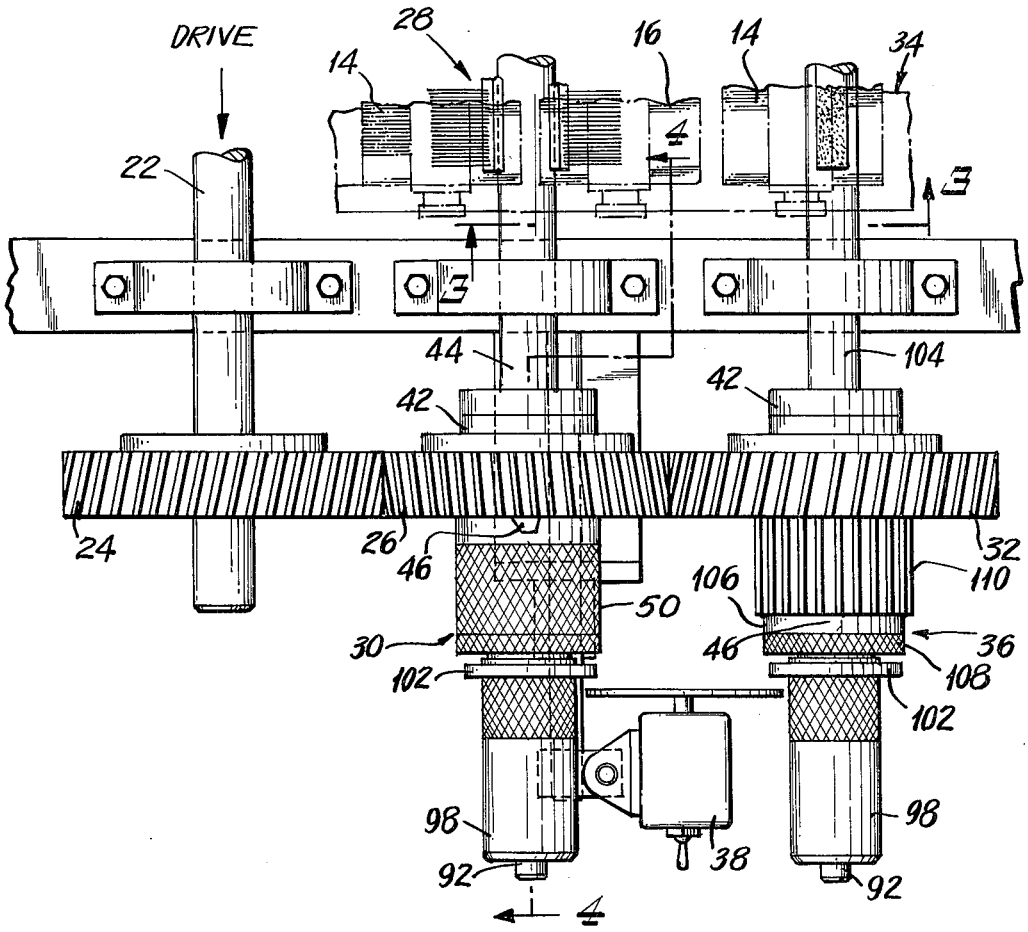
FIG. 2 is an enlarged fragmentary plan view of the napper drive release mechanism as viewed along line 2—2 of FIG. 1.

With reference to FIGS. 1 and 2, a drive shaft 22 is driven synchronously with carrier 12 through a suitable gear drive (not shown). A stripper drive gear 24 is mounted on shaft 22 for rotation therewith and engages gear 26 which drives a first napper stripper 28 through overload clutch release 30 in a manner to be more fully explained below. Gear 26 also engages a second gear 32 which drives a second napper stripper 34 through a second overload clutch release 36.

Figure 3:
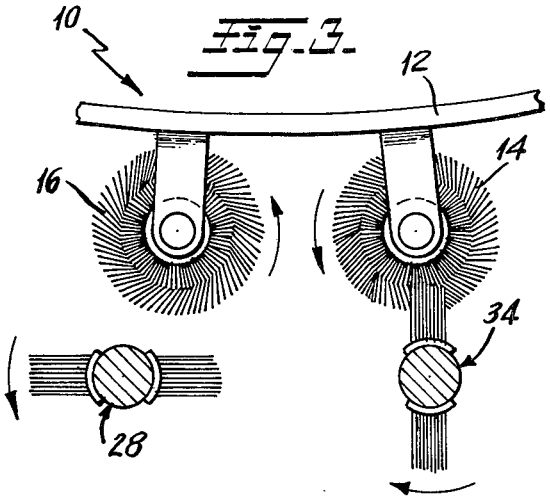
FIG. 3 is a fragmentary vertical-sectional view, taken along line 3—3 of FIG. 2 and showing the relationship of the napper stripper brushes to the napping rollers.

As can be seen in FIG. 3, napper strippers 28 and 34 comprise brush-like elements that comb the card cloth material of the napper rollers 14 and 16 in a manner such that any lint attached the the napper rollers will be dislodged from the card cloth by the napper strippers. It will be evident that it is essential for the strippers 28, 34 to operate in a timed relationship with respect to the napper rollers 14, 16 so that the roller 14, for example, will be contacted only by stripper 34, and napper 16 will be contacted only by stripper 28. Otherwise, the card cloth on the napper rollers would be damaged by contacting a stripper that was rotating in the wrong sense.

In FIGS. 1 and 2, mechanism 38 has an automatic shut-off switch that stops the napper apparatus as soon as the overload clutch is released. The precise manner of operation of shut-off switch 38 will become more apparent in connection with the description of the operation of the clutch itself which is set forth below.

Figure 7:
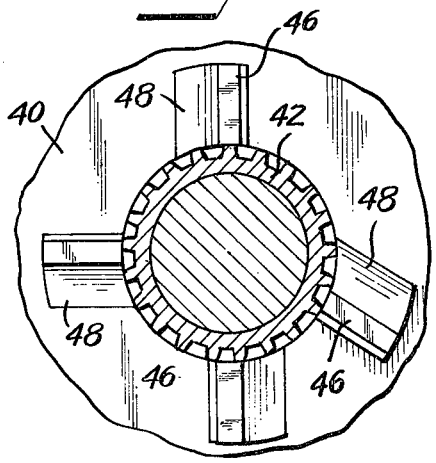
FIG. 7 is an enlarged transversed sectional view taken along line 7—7 of FIG. 4, with portions removed for clarity.
Figures 4, 5, 6:
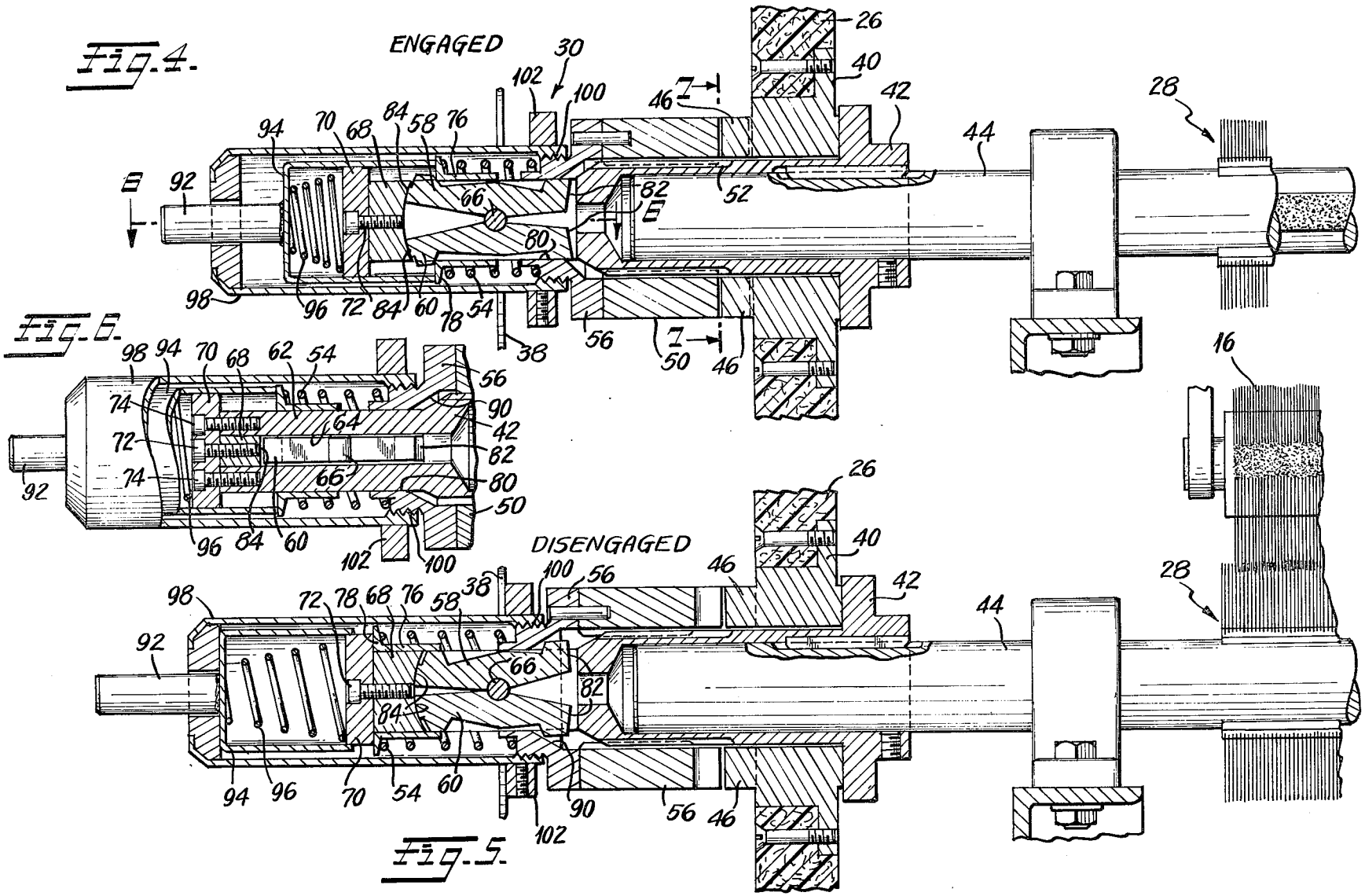
FIG. 4 is an enlarged fragmentary vertical-sectional view, taken along the line 4—4 of FIG. 2.
FIG. 5 is a vertical sectional view similar to FIG. 4, but showing the clutch in its disengaged position.
FIG. 6 is a fragmentary vertical section taken along the line 6—6 of FIG. 4.

In FIG. 4, release clutch 30, which is essentially similar to clutch 36, is illustrated in cross-section to show the internal operating mechanisms. Gear 26, which is illustrated as a fiber gear element, is mechanically secured to a hub member 40, that is freely rotatable upon annular collet 42 which is rigidly connected directly or through a suitable connection to drive shaft 44 of napper stripper 28. Hub 40 comprises a first clutch member and is provided on its front radial face with axially extending lug projections 46 that are more clearly illustrated in FIG. 7. Lugs 46 have inclined cam faces 48 and the lugs are asymetrically located on the front face of the hub so that they will engage mating cam follower slots or recesses in the adjacent radial face of a second, axially sliding, clutch member 50, when 40 and 50 are properly aligned. Clutch member 50 is splined to collet 42 for rotation therewith and with shaft 44, but member 50 is free to axially slide along the splines 52 (see FIG. 7) of collet 42.

Axially sliding clutch member 50 is normally axially spring-biased to the right as viewed in FIG. 4 by the means of spring 54 which acts on the second clutch member 50 through a pressure plate member 56 that is pinned to clutch member 50 so that it is positively driven therewith.

A pair of pivoted latch pins 58, 60 are provided within the end portion of collet 42, which end portion, as shown in FIG. 6, is a cylindrical shaft extension 62 of collet 42 having a central groove 64 milled out of the central portion of the shaft. Within the groove 64, pins 58 and 60 are loosely disposed, along with a fulcrum pin 66. The latch pins 58, 60 are retained within the groove 64 by means of an end piece 68 that is connected to an end plate 70 by means of a fastener 72. The end plate 70, in turn, is fastened rigidly to the end of the shaft portion 62 of collet 42 by means of fasteners 74.

Slidably mounted on shaft 62 there is provided an annular spring retainer collar 76 having a radially projecting portion 78 against which spring 54 is pressed. Spring 54, therefore, extends between the pressure plate 56 seen at the right of the spring 54 in FIG. 4, and the radial portion 78 of the collar 76 on the left.

Pressure plate 56 is provided with an internal cylindrical bore 80 that fits closely over shaft 62 of collet 42 so that a smooth sliding relationship between plate 56 and shaft 62 is obtained. The pins 58, 60, along with their fulcrum pin 66, are all dimensioned such that the enlarged ends 82 of the pins (to the right in FIG. 4) fit snugly within the bore 80 while the enlarged ends 84 of the pins 58, 60 (to the left in FIG. 4) extend beyond the periphery of shaft 62 when ends 82 of the pins are disposed within the bore 80 of the pressure plate 56. Thus, the collar 76 is locked in place on the shaft 62 by the ends 84 of pins 58, 60 as long as the ends 82 of the pins are disposed within the bore 80 of the pressure plate 56.

It will be evident that if pressure plate 56 is urged to the left along the shaft 62, a point will be reached where the ends 82 of pins 58, 60 will clear the bore 80, whereupon the pins 58, 60 can pivot about fulcrum 66 so that ends 84 move closer to each other, while ends 82 of the pins move radially outwardly. The pins are dimensioned and fulcrum so that both ends of the pins cannot be located within the circumference of shaft 62 simultaneously. When ends 82 move outwardly, ends 84 move inwardly so that collar 76 can move to the left in FIG. 4 to the position illustrated in FIG. 5. The radially projecting portion 78 of collar 76 now is lodged against the end plate 70 and the spring 54 is extended. Pressure plate 56 has moved to the left and is held in this position because the left ends 84 of pins 58, 60 are now disposed within a bore 86 of the collar 76. Since the ends 82 of the pins 58, 60 now project radially beyond the circumference of shaft 62, pressure plate 56 is prevented from sliding back to the right as viewed in FIG. 5. Movement of the pressure plate 56 to the right is only enabled when the collar 76 is urged to the right a sufficient distance to enable the left ends 84 of pins 58, 60 to project outwardly beyond the circumference of shaft portion 62 of collet 42. At that point, the spring 54 urges the pressure plate 56 to the right and the side walls of the tapered bore 80 within pressure plate 56 cams the ends 82 of the pins 58, 60 inwardly to a sufficient extent that the pressure plate 56 can resume its original position as shown in FIG. 4.

To enable manipulation of collar 76 over the left ends 84 of pins 58, 60, external pushbutton 92 is provided, in combination with a generally cylindrical connecting tube element 94 that closely fits over end plate 70. Within connecting tube 94, a spring 96 extends between a closed end of tube 94 and the end plate 70, so that tube 94 and pushbutton 92 are normally urged to the left as viewed in FIGS. 4 and 5. When it is desired to cause pressure plate 56 to move to the right, pushbutton 92 is forced inwardly and this results in the collar 76 being urged to the right as viewed in FIG. 5 in order to clear the ends 84 of latch pins 58, 60. In FIG. 4, the pushbutton 92 and the connecting tube 94 are illustrated at their full inward positions.

An outer cylindrical housing 98 is secured to end plate 56 by means of a threaded connection 100, or other suitable means. A radial extension 102 on housing 98 serves to transmit axial motion of housing 98 to the napper machine shut-off switch 38.

The second clutch 36 connected to drive shaft 104 of napper stripper 34 is substantially identical to the clutch 30 illustrated in FIGS. 4, 5 and 6. However, axially slidable clutch element 106 (See FIG. 2) corresponds to axially slidable element 50 of clutch 30, and pressure plate 108 corresponds to pressure plate 56 of clutch release 30. The narrower dimensions of members 106 and 108 provide space for a second set of gear teeth 110 provided on the hub of gear 32. The second set of gear teeth enable the system to be adapted to an alternate form of napper machine (not illustrated) wherein a different input drive gear 124 to the napper strippers engages gear teeth 110 rather than gear 26.

In operation, rotation of carrier 12 causes synchronous rotation of drive shaft 22 which causes synchronous rotation of drive shafts 44 and 104 of napper strippers 28 and 34 through clutch release mechanisms 30 and 36, respectively. Rotary motion applied to gear 26 is transmitted to shaft 44 through hub 40, clutch lugs 46 and axially slidable clutch member 50.

Axial movement of clutch member 50 and pressure plate 56 to the left as illustrated is resisted by spring 54. However, when rotation of shaft 44 is impeded, such as by a fabric web jam, the pressure plate 56 is urged out by the camming action of the lugs 46 until ends 82 of latch pins 58, 60 clear the end of bore 80 of pressure plate 56. Pins 58, 60 can then rotate about fulcrum 66 and the collar 76 then is urged to the left by the spring 54 until it reaches end plate 70.

Pressure plate 56 and clutch member 50 are now locked in the release position shown in FIG. 5, with clutch member 50 disengaged from the hub 40. Hub 40 and gear 26 are now free to rotate about collet 42 without transmitting motion to shaft 44, although drive motion to napper 34 is not disturbed.

After the jam that initially caused the overload condition has been cleared from the napper stripper 28, shaft 44 is manually rotated until the lugs 46 match the recesses in the end of clutch face 50. This places napper stripper 28 back in time with the rest of the napper machine. Pushbutton 92 is pushed inwardly and the clutch is automatically reset in the position shown in FIG. 4 after the collar 76 has cleared the end 84 of latch pins 58, 60. Of course, the spring can be reset first and the shaft 44 then rotated to its correct position to cause the lugs to engage the recesses, if desired.

Since release of clutch mechanism 30 does not affect clutch 36 connected to the second napper stripper drive shaft 104, drive shaft 104 is never out of time with respect to drive gear 24 regardless of the engagement or disengagement of clutch release 30. Likewise, if the second napper stripper 34 becomes jammed, clutch mechanism 36 will release while clutch mechanism 30 remains engaged. Under such conditions, the timing of napper stripper 28 will not be affected by the release of clutch mechanism 36 on the other napper stripper drive shaft.

The provision of a pair of clutch mechanisms 30, 36 enables a lighter spring 54 to be utilized as compared to a situation where a single clutch mechanism is used for both drive shafts 44, 104 of the napper strippers. This is so, because the spring 54 only need be strong enough to insure that its respective clutch mechanism can transmit an appropriate drive torque to its own respective napper stripper. The use of a lighter spring has the advantage that the clutch can release at a smaller overload condition than if a single, heavier spring were used to transmit full drive torque to both of the napper strippers. Thus, a more sensitive clutch release system is provided using the pair of clutch elements in accordance with the present invention. Since the clutch will release quicker, the fabric being treated is protected to a greater extent, as are the mechanisms protected by the overload release.

Only the preferred embodiment of the present invention has been illustrated and described in the foregoing specification. It should be understood that various modifications can be made to the structure without departing from the scope of the invention.

I claim:

1. In a cloth napper apparatus including rotatable napper rollers carried by a rotatable annular carrier, and at least a pair of napper stripper drive shafts interconnected by drive gearing to each other and to a drive means for the carrier, the improvement comprising:

(a) each stripper drive shaft having a stripper drive gear coaxially mounted thereon, the stripper drive gears being engaged with one another;

(b) at least one input drive gear engaged with one of the stripper drive gears, and drivingly connected to the carrier drive means in a manner enabling timed rotation of the stripper drive shafts with respect to the carrier;

(c) separate and independent overload release clutch means mounted on each stripper drive shaft;

(d) each clutch means releasably connecting each stripper drive gear to its respective drive shaft when the clutch means is engaged;

(e) each stripper drive gear being freely rotatable about the respective stripper drive shaft when the clutch means is disengaged;

(f) means for positively holding the clutch in its disengaged position when it becomes disengaged;

(g) means for resetting the clutch to its engaged position from a disengaged position; and (h) means for preventing resetting of the clutch means to its engaged position unless the respective stripper drive shaft and stripper drive gear connected to the clutch means are in a predetermined rotational angular relationship to each other.

2. The cloth napper apparatus according to claim 1, wherein:

(a) each clutch means includes a first member fixed to the respective napper stripper drive gear associated with the clutch means;

(b) said first member having a pattern of lugs with axially projecting cam surfaces on a radial surface of the first member;

(c) a second member drivingly connected to but axially slidable relative to, the respective napper stripper drive shaft, and having a cooperative pattern of cam follower recesses on a radial surface thereof adapted to axially engage the lugs of the first member when the clutch is engaged;

(d) spring means for biasing the second member axially towards the first member;

(e) latch means for positively preventing engagement of the recesses of the second member with the lugs of the first member when the clutch is in its disengaged position;

(f) means for disabling the latch means to permit axial engagement of said recesses and lugs; and (g) said latch means being carried by and forming a part of the clutch means.

3. The cloth napper apparatus according to claim 2 including a napper apparatus shut-off means including a sensor element responsive to axial movement of said second clutch member in a direction away from said first member for shuting off the napper apparatus when the clutch is disengaged.

4. The cloth napper apparatus according to claim 3, wherein said first member is a hub of said napper stripper drive gear, and a collet mounted on the napper stripper drive shaft for rotation therewith, said hub being rotatably mounted on said collet.

* * * * *